US008167295B2

(12) United States Patent
Hashimoto

(10) Patent No.: US 8,167,295 B2
(45) Date of Patent: May 1, 2012

(54) PRINTER AND METHOD FOR CONTROLLING THE SAME

(75) Inventor: Naoki Hashimoto, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/860,314

(22) Filed: Aug. 20, 2010

(65) Prior Publication Data

US 2011/0097130 A1 Apr. 28, 2011

(30) Foreign Application Priority Data

Oct. 28, 2009 (JP) ..... 2009-248128

(51) Int. Cl.
*B65H 5/26* (2006.01)

(52) U.S. Cl. ..... 271/9.02; 271/9.03; 271/9.05

(58) Field of Classification Search ..... 271/9.02, 271/9.03, 9.05, 9.01
See application file for complete search history.

(56) References Cited

U.S. PATENT DOCUMENTS

| | | | | |
|---|---|---|---|---|
| 4,484,734 | A * | 11/1984 | Tsudaka et al. | 271/9.03 |
| 5,168,316 | A * | 12/1992 | Hino et al. | 399/23 |
| 5,195,734 | A * | 3/1993 | Tanabe | 271/9.03 |
| 5,393,043 | A | 2/1995 | Nitta | |
| 5,523,822 | A * | 6/1996 | Tsuda | 399/13 |
| 5,991,556 | A * | 11/1999 | Yamashita | 399/23 |
| 6,010,261 | A * | 1/2000 | Maekawa | 400/605 |
| 7,817,926 | B2 | 10/2010 | Yano | |
| 2006/0067716 | A1 | 3/2006 | Yano | |
| 2008/0258374 | A1* | 10/2008 | Inoue | 271/9.03 |
| 2009/0166949 | A1* | 7/2009 | Unno | 271/9.03 |

FOREIGN PATENT DOCUMENTS

| | | |
|---|---|---|
| JP | 05-186096 | 7/1993 |
| JP | 05-221554 | 8/1993 |
| JP | 6064767 A | 3/1994 |
| JP | 11-084778 | 3/1999 |
| JP | 11157681 A | 6/1999 |
| JP | 2000-007174 | 1/2000 |
| JP | 2000-062985 | 2/2000 |
| JP | 2002-068526 | 3/2002 |
| JP | 2005-134810 | 5/2005 |
| JP | 2006-096456 | 4/2006 |
| JP | 2006-224379 | 8/2006 |

OTHER PUBLICATIONS

Notification of Reasons for Rejection for Japanese patent application No. 2009-248128 mailed Oct. 4, 2011.
Decision of Rejection for Japanese patent application No. 2009-248128 mailed Jan. 24, 2012.

* cited by examiner

*Primary Examiner* — David H Bollinger
(74) *Attorney, Agent, or Firm* — Banner & Witcoff, Ltd.

(57) ABSTRACT

A printer is provided that includes a printing unit printing an image on a sheet being conveyed on a printing path, a first feeder unit configured such that a sheet placed thereon is fed to the printing path via a first feeding path, a second feeder unit configured such that a sheet placed thereon is fed to the printing path via a second feeding path even while the first feeder unit is being replenished with sheets, and a controller configured to, in response to a first requirement being satisfied while the first feeder unit is forbidden to be replenished with sheets during a continuous printing operation, switch an actually-working feeder unit that works for actual sheet feeding in the continuous printing operation, to the second feeder unit, the first requirement including a condition that one or more sheets are placed on the second feeder unit.

14 Claims, 8 Drawing Sheets

41

CAUTION

There is no sheet in the upper feed cassette.
When you want to replenish the upper feed cassette with sheets before completion of the printing, please press the switch button on the operation panel.

FIG. 5

41

GUIDANCE FOR SHEET REPLENISHMENT

Please set sheets on the multipurpose tray.
The size of settable sheets is A4.
(The feeder unit will automatically be switched to the multipurpose tray after sheets are set thereon.)

FIG. 7

41

GUIDANCE FOR SHEET REPLENISHMENT

It is possible to replenish the upper feed cassette with sheets.
The size of settable sheets is A4.

FIG. 8

41

GUIDANCE FOR SHEET REPLENISHMENT

It is confirmed that sheet replenishment for the upper feed cassette has been completed.

(The feeder unit will automatically be switched to the upper feed cassette after all sheets are fed out of the multipurpose tray.)

FIG. 9

PRINTER AND METHOD FOR CONTROLLING THE SAME

CROSS-REFERENCE TO RELATED APPLICATION

This application claims priority under 35 U.S.C. §119 from Japanese Patent Application No. 2009-248128 filed on Oct. 28, 2009. The entire subject matter of the application is incorporated herein by reference.

BACKGROUND

1. Technical Field

The following description relates to one or more technologies for a printer having a plurality of feeder units, more specifically, to one or more technologies for replenishing an intended one of the feeder units with sheets during a continuous printing operation.

2. Related Art

A printer having a plurality of feeder units has been known. For instance, an image forming device has been known that is provided with a feed tray (a main body feed tray) disposed in a bottom region of the image forming device and configured such that another feed tray (an additional feed tray) can be installed under the main body feed tray.

Further, when a sheet-empty state is detected at a feeder unit specified by a print job (i.e., when a state where there is no sheet left in the specified feeder unit is detected) during a continuous printing operation, the printer interrupts the printing operation and waits for the specified feeder unit to be replenished with sheets. Then, in response to detection of a state where the sheet replenishment for the specified feeder unit is completed, the printer resumes the printing operation.

SUMMARY

However, the known printer has a problem that there are some cases where a feeder unit is forbidden to be replenished with sheets during a continuous printing operation. For example, the known image forming device is configured to, when the upper main body feed tray is pulled out, interrupt a sheet feeding path that is continuous from the lower additional feed tray. Therefore, while sheet feeding is being performed from the additional feed tray, the main body feed tray is forbidden to be replenished with sheets. Further, for instance, once a continuous printing operation is launched, a feeder unit that works for actual sheet feeding in the continuous printing operation (i.e., an actually-working feeder unit) is forbidden to be replenished with sheets until the continuous printing operation is terminated or the sheet-empty state is detected.

Aspects of the present invention are advantageous to provide one or more improved techniques for a printer that make it possible to replenish an intended feeder unit with sheets even during a continuous printing operation.

According to aspects of the present invention, a printer is provided that includes a printing unit configured to print an image on a sheet which is being conveyed on a printing path, a first feeder unit configured such that a sheet placed thereon is fed to the printing path via a first feeding path, a second feeder unit configured such that a sheet placed thereon is fed to the printing path via a second feeding path even while the first feeder unit is being replenished with sheets, and a controller configured to, in response to a first requirement being satisfied while the first feeder unit is forbidden to be replenished with sheets during a continuous printing operation, switch an actually-working feeder unit that works for actual sheet feeding in the continuous printing operation, to the second feeder unit. The first requirement includes a condition that one or more sheets are placed on the second feeder unit.

According to aspects of the present invention, further provided is a printer that includes a printing unit configured to print an image on a sheet which is being conveyed on a printing path, a first feeder unit configured such that a sheet placed thereon is fed to the printing path via a first feeding path, a second feeder unit configured such that a sheet placed thereon is fed to the printing path via a second feeding path that is forbidden to feed a sheet thereon while the first feeder unit is being replenished with sheets, a third feeder unit configured such that a sheet placed thereon is fed to the printing path via a third feeding path that is formed independently from the first and second feeding paths so as to feed a sheet thereon even while the first feeder unit is being replenished with sheets, and a controller configured to, in response to detecting a state where there is no sheet on the first feeder unit during sheet feeding from the first feeder unit, switch an actually-working feeder unit that works for actual sheet feeding, to the second feeder unit, and in response to a first requirement being satisfied during sheet feeding from the second feeder unit, switch the actually-working feeder unit to the third feeder unit, wherein the first requirement comprises a condition that one or more sheets are placed on the third feeder unit, and in response to a second requirement being satisfied during sheet feeding from the third feeder unit, restore the actually-working feeder unit to the first feeder unit, wherein the second requirement comprises a condition that an operation of replenishing the first feeder unit with sheets is completed.

According to aspects of the present invention, further provided is a method, configured to be implemented on a processor, for controlling a printer. The printer includes a printing unit configured to print an image on a sheet which is being conveyed on a printing path, a first feeder unit configured such that a sheet placed thereon is fed to the printing path via a first feeding path, and a second feeder unit configured such that a sheet placed thereon is fed to the printing path via a second feeding path even while the first feeder unit is being replenished with sheets. The method includes a step of, in response to a first requirement being satisfied while the first feeder unit is forbidden to be replenished with sheets during a continuous printing operation, switching an actually-working feeder unit that works for actual sheet feeding in the continuous printing operation, to the second feeder unit. The first requirement includes a condition that one or more sheets are placed on the second feeder unit.

BRIEF DESCRIPTION OF THE ACCOMPANYING DRAWINGS

FIG. 1 is a perspective view schematically showing an external configuration of a printer in an embodiment according to one or more aspects of the present invention.

FIG. 2 schematically shows an internal configuration of the printer in the embodiment according to one or more aspects of the present invention.

FIG. 5 exemplifies a message displayed in the printing process to provide the user with a precaution in advance of sheet replenishment in the embodiment according to one or more aspects of the present invention.

Figure 6:
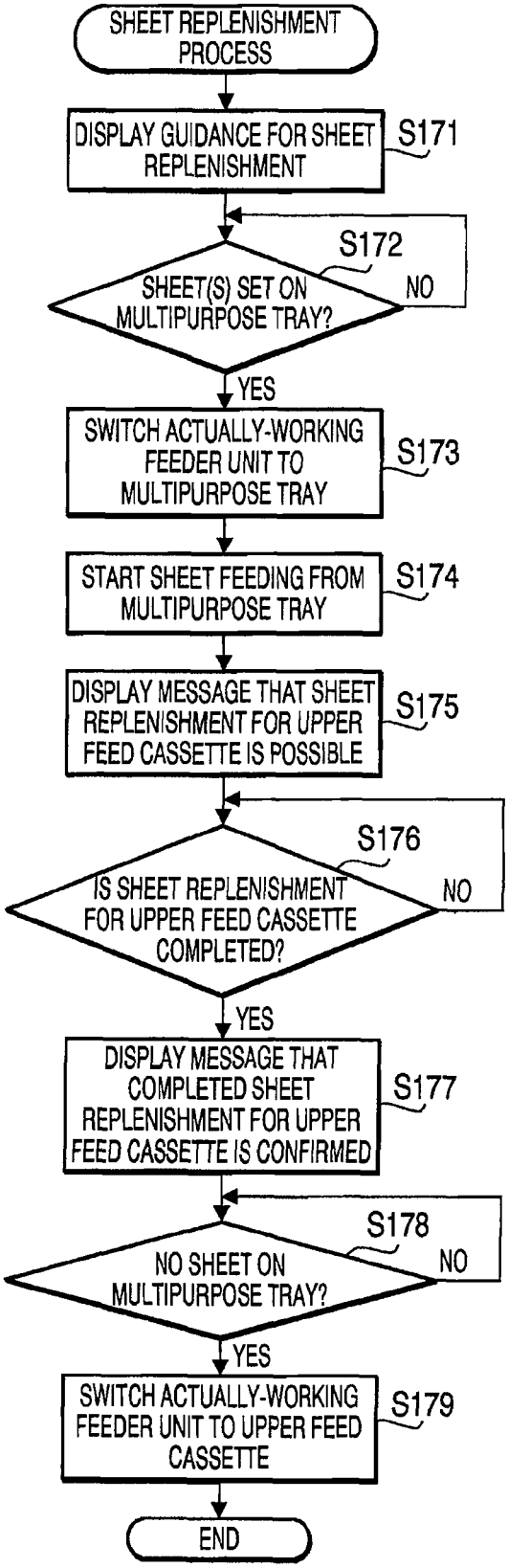

FIG. 6 is a flowchart showing a procedure of a sheet replenishment process in the embodiment according to one or more aspects of the present invention.

FIGS. 7 to 9 exemplify messages displayed in accordance with progress of the sheet replenishment process t in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described with reference to the accompany drawings. In the embodiment, aspects of the present invention are applied to a printer configured to perform printing in an electrophotographic method.

[Configuration of Printer]

Figure 1:
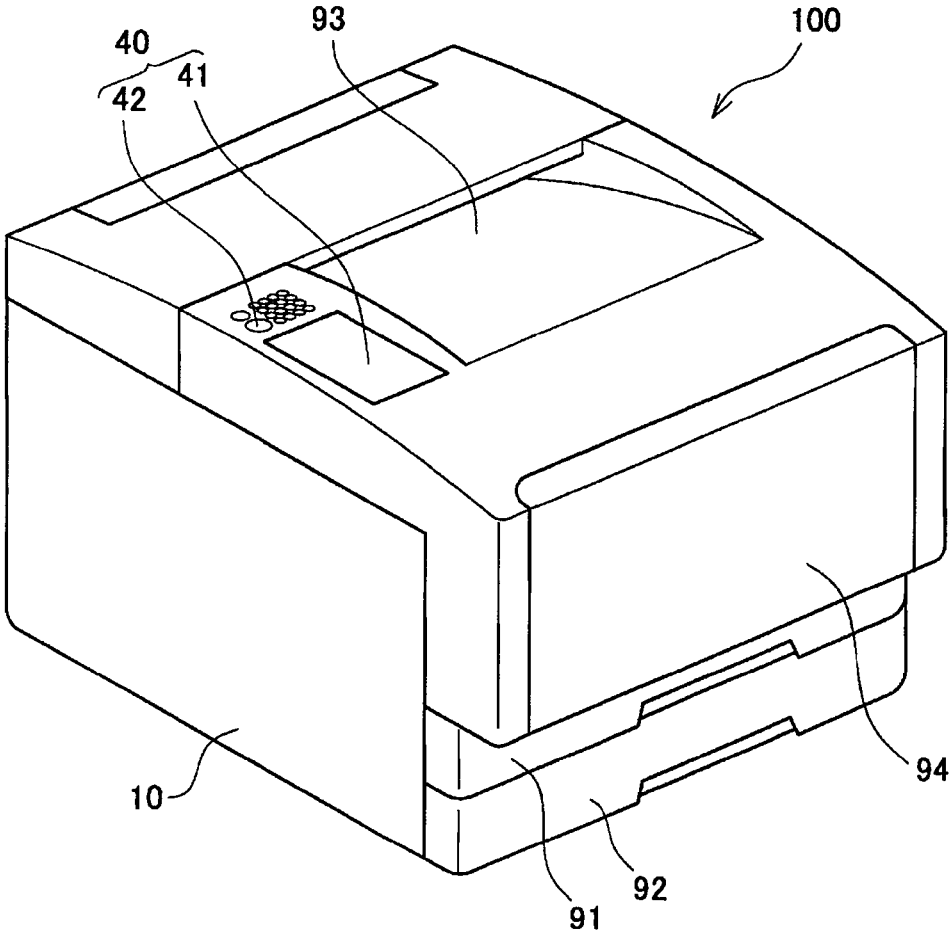

As illustrated in FIG. 1, a printer 100 of the embodiment includes a main body unit 10 for printing an image on a sheet, an upper feed cassette 91 and a lower feed cassette 92 that are disposed at a bottom side of the main body unit 10, a catch tray 93 formed on an upper face of the main body unit 10, and a multipurpose tray 94 disposed on a side face of the main body unit 10.

The multipurpose tray 94 is configured to rotate around a shaft (not shown) provided at a lower side thereof so as to be opened and closed relative to the main body unit 10. When closed as shown in FIG. 1, the multipurpose tray 94 covers the side face of the main body unit 10. Meanwhile, when opened, the multipurpose tray 94 serves as a tray on which sheets can be placed. For example, the multipurpose tray 94 is used for feeding sheets of a size which does not conform to the upper feed cassette 91 or the lower feed cassette 92.

Further, the main body unit 10 includes an operation panel 40 disposed on the upper face of the main body unit 10. The operation panel 40 is provided with a display unit 41 having a liquid crystal display (LCD) device, and a button group 42 having various buttons such as a start key, a stop key, and numeric keypad. The display unit 41 and the button group 42 make it possible to display an operational status and accept an input from a user.

[Configuration of Main Body Unit]

Figure 2:
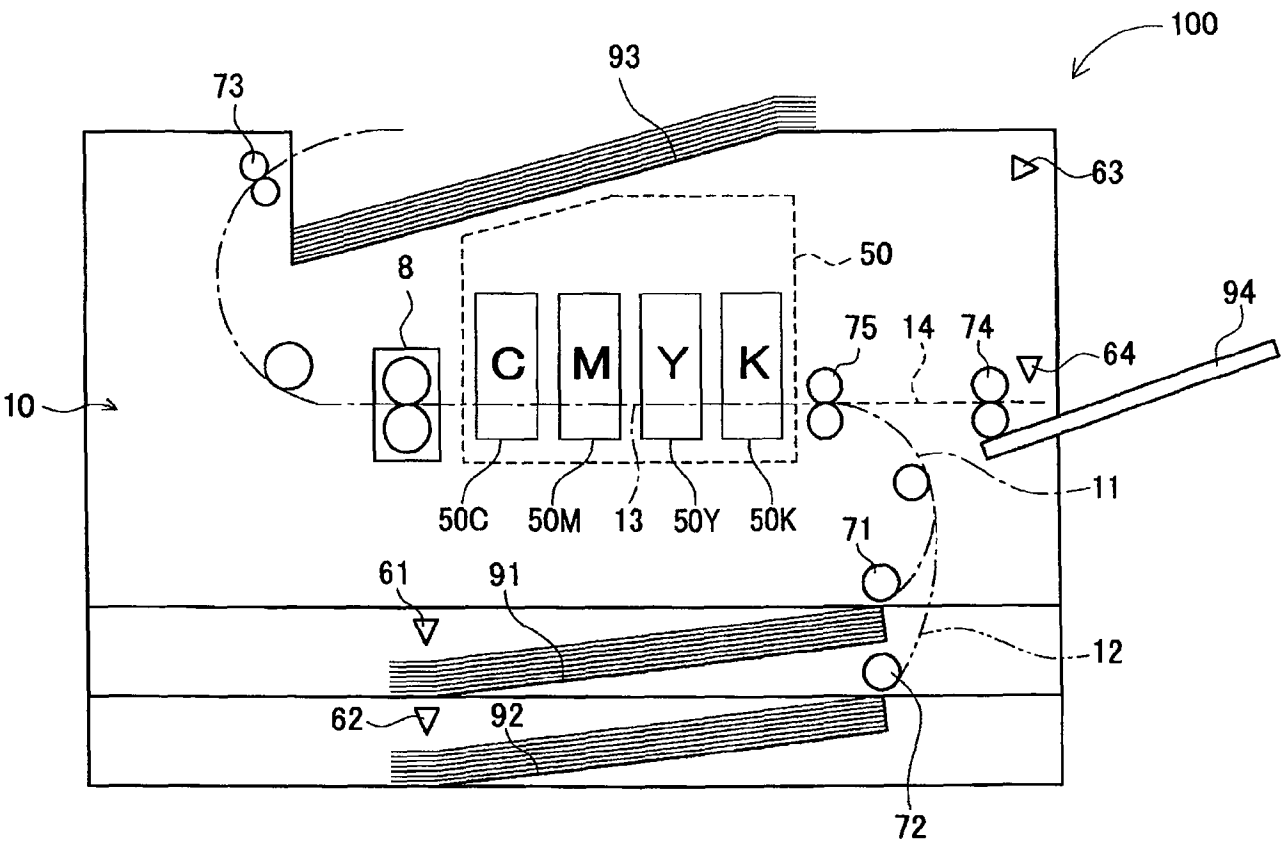

The main body unit 10 is configured to form an image in a known electrophotographic method. As depicted in FIG. 2, the main body unit 10 includes a process portion 50 for forming an image, and a fixing unit 8 for fixing an unfixed toner image. The main body unit 10 further includes the upper feed cassette 91, the lower feed cassette 92, and the multipurpose tray 94 that are configured such that unprinted sheets are placed thereon. The main body unit 10 further includes the catch tray 93 configured to receive printed sheets thereon.

The main body unit 10 further includes therein a substantially S-shaped feeding path (indicated by an alternate long and short dash line in FIG. 2) formed to guide sheets placed in the upper feed cassette 91 upward to the catch tray 93 via a feed roller 71, registration rollers 75, the process portion 50, the fixing unit 8, and ejection rollers 73. Specifically, the main body unit 10 is configured to pick up sheets placed in the upper feed cassette 91 on a sheet-by-sheet basis, convey the picked-up sheet to the process portion 50, and transfer onto the sheet a toner image formed by the process portion 50. Further, the main body unit 10 conveys the sheet with the toner image transferred thereon to the fixing unit 8 and fixes the toner image onto the sheet. Then, the main body unit 10 ejects, onto the catch tray 93, the sheet with the toner image fixed thereon. It is noted that on the substantially S-shaped feeding path, a section from the upper feed cassette 91 to the registration rollers 75 (a confluence where a below-mentioned feeding path 14 joins) will be referred to as a feeding path 11, and a section from the registration rollers 75 to the catch tray 93 will be referred to as a feeding path 13.

Further, the main body unit 10 includes a feeding path 12 (indicated by an alternate long and two short dashes line in FIG. 2) that extends from the lower feed cassette 92, via a feed roller 72, to join the feeding path 11 at an upstream side relative to the registration rollers 75 in a sheet feeding direction. In other words, when feeding sheets from the lower feed cassette 92, the main body unit 10 picks up a sheet from the lower feed cassette 92, and conveys the sheet to the registration rollers 75 through the upper feed cassette 91.

Since the main body unit 10 is configured as above, the upper feed cassette 91 is forbidden to be replenished with sheets during sheet feeding from the lower feed cassette 92. Specifically, as described above, the feeding path 12 continuous from the lower feed cassette 92 passes through the upper feed cassette 91. Thus, when the upper feed cassette 91 is pulled out of the main body unit 10 during sheet feeding from the lower feed cassette 92, the feeding path 12 is interrupted to be unable to feed sheets thereon. Therefore, it is undesired to replenish the upper feed cassette 91 with sheets during sheet feeding from the lower feed cassette 92.

In addition, the main body unit 10 includes a feeding path 14 (indicated by a dashed line in FIG. 2) that extends from the multipurpose tray 94, via carrying rollers 74, to join the feeding path 11 in a position where the registration rollers 75 are disposed. The multipurpose tray 94 is disposed in a position higher than the upper feed cassette 91 and the lower feed cassette 92. Therefore, a sheet fed from the multipurpose tray 94 is conveyed to the registration rollers 75 without passing through the upper feed cassette 91 or the lower feed cassette 92. Thus, sheet replenishment for the upper feed cassette 91 and the lower feed cassette 92 exerts no influence on the sheet feeding from the multipurpose tray 94.

The process portion 50 includes a process unit 50C for forming a cyan (C) colored image, a process unit 50M for forming a magenta (M) colored image, a process unit 50Y for forming a yellow (Y) colored image, and a process unit 50K for forming a black (K) colored image. The process units 50C, 52M, 50Y, and 50K are arranged along the feeding path 13. The process portion 50 is configured to form a color image by sequentially overlaying, on a sheet, respective toner images formed by the process units 50K, 50Y, 50M, and 50C. Meanwhile, in forming a monochrome image, the process portion 50 performs printing to form a toner image with one of the process units 50C, 52M, 50Y, and 50K.

Further, the main body unit 10 includes various sensors disposed therein, such as a sheet sensor 61 for detecting a sheet in the upper feed cassette 91, a sheet sensor 62 for detecting a sheet in the lower feed cassette 92, a cover sensor 63 for detecting an open state of the multipurpose tray 94, and a sheet sensor 64 for detecting a sheet on the multipurpose tray 94. Each of the sheet sensors 61, 62, and 64 has a light emitting element configured to emit light and a light receiving element configured to detect the light intensity of light received from the light emitting element. Thereby, each of the sheet sensors 61, 62, and 64 detects the presence of a sheet, based on the difference between the light intensities in a sheet-remaining state where there is a sheet and a sheet-empty state where there is no sheet. Further, based on the change of the light intensity, each of the sheet sensors 61, 62, and 64 detects a change from the sheet remaining state to the sheet-empty state or the reverse change. The cover sensor 63 also has a light emitting element configured to emit light and a light receiving element configured to detect the light intensity of light received from the light emitting element. Thereby, the cover sensor 63 optically detects whether the multipurpose tray 94 is open or closed. It is noted that the aforementioned sensors 61 to 64 are not limited to optical sensors, but may be general sensors usable for detecting whether there is a sheet or whether a cover is open or closed.

[Electrical Configuration of Printer]

Figure 3:
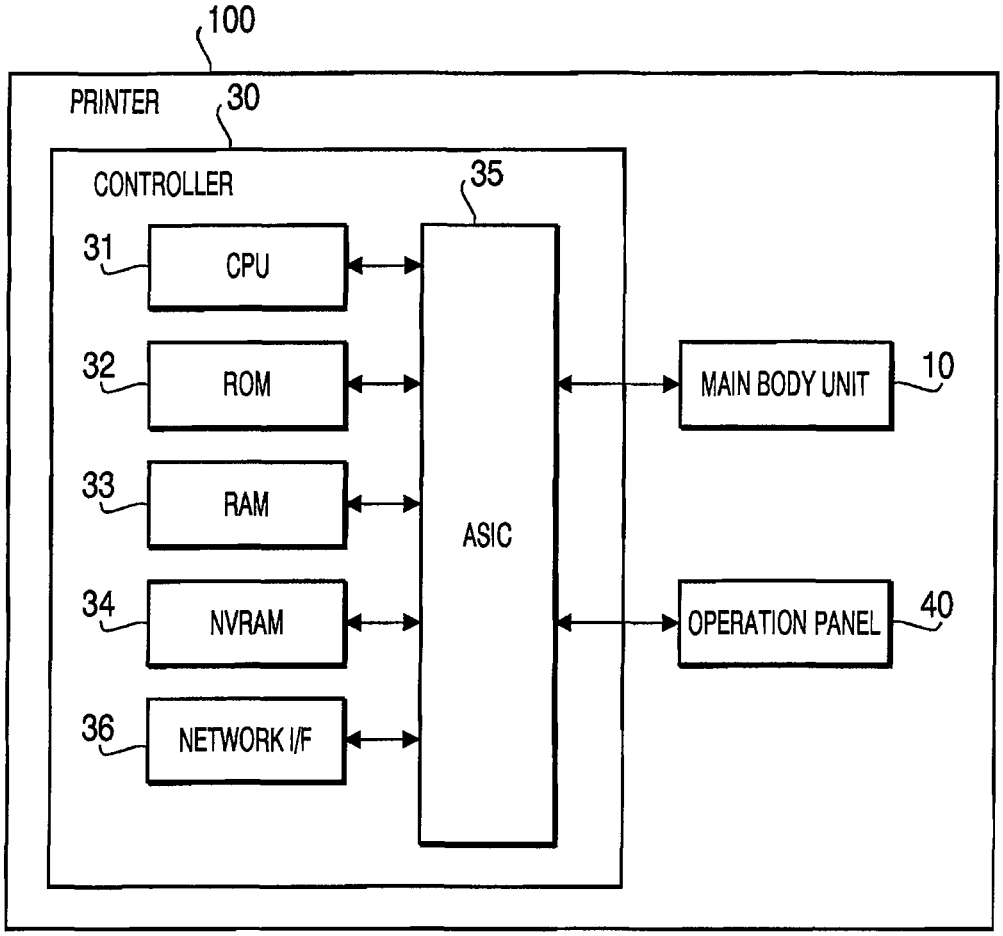
FIG. 3 is a block diagram schematically showing an electrical configuration of the printer in the embodiment according to one or more aspects of the present invention.

Subsequently, an explanation will be provided about an electrical configuration of the printer 100. As illustrated in FIG. 3, the printer 100 has a controller 30 that includes a CPU 31, a ROM 32, a RAM 33, an NVRAM 34, an ASIC 35, and a network interface 36.

The CPU 31 performs computing operations to achieve various functions such as an image forming function of the printer 100, as a central processor to control the printer 100. The ROM 32 stores various kinds of data to control the printer 100, such as various control programs, various settings, and initial values. The RAM 33 is utilized as a work area into which various control programs are read out or a storage area to temporarily store image data. The NVRAM 34 is a non-volatile memory utilized as a storage area to store various settings and image data.

While storing, into the RAM 33 or the NVRAM 34, results of processing in accordance with the control programs read out of the ROM 32 and signals received from the various sensors, the CPU 31 controls each element of the printer 100 via the ASIC 35 (e.g., the CPU 31 controls an exposure unit (not shown) of the process unit 50 to be turned on or off at appropriate timing, and controls drive motors (not shown) of rollers on the feeding path).

The network interface 36 is connectable with a network such as the Internet, so as to establish connection with information processing devices such as personal computers and mobile terminal devices. Thus, the printer 100 can perform data communication with the information processing devices via the network interface 36.

[Printing Operation]

Subsequently, an explanation will be provided about a printing operation of the printer 100, focusing attention on switching of feeder units. The printer 100 has a function to automatically switch feeder units between the upper feed cassette 91 and the lower feed cassette 92. In the automatic switching function, when a sheet-empty state where there is no sheet is detected at one of the feed cassettes 91 and 92 during a continuous printing operation, the printer 100 automatically switches to the other feed cassette and maintains the continuous printing operation.

In addition, the printer 100 has a function to temporarily switch a feeder unit that works for actual sheet feeding in the continuous printing operation (i.e., an actually-working feeder unit) to the multipurpose tray 94. The switching to the multipurpose tray 94 is achieved by pressing a switch button (not shown) provided on the operation panel 40.

[Printing Process]

Figure 4:
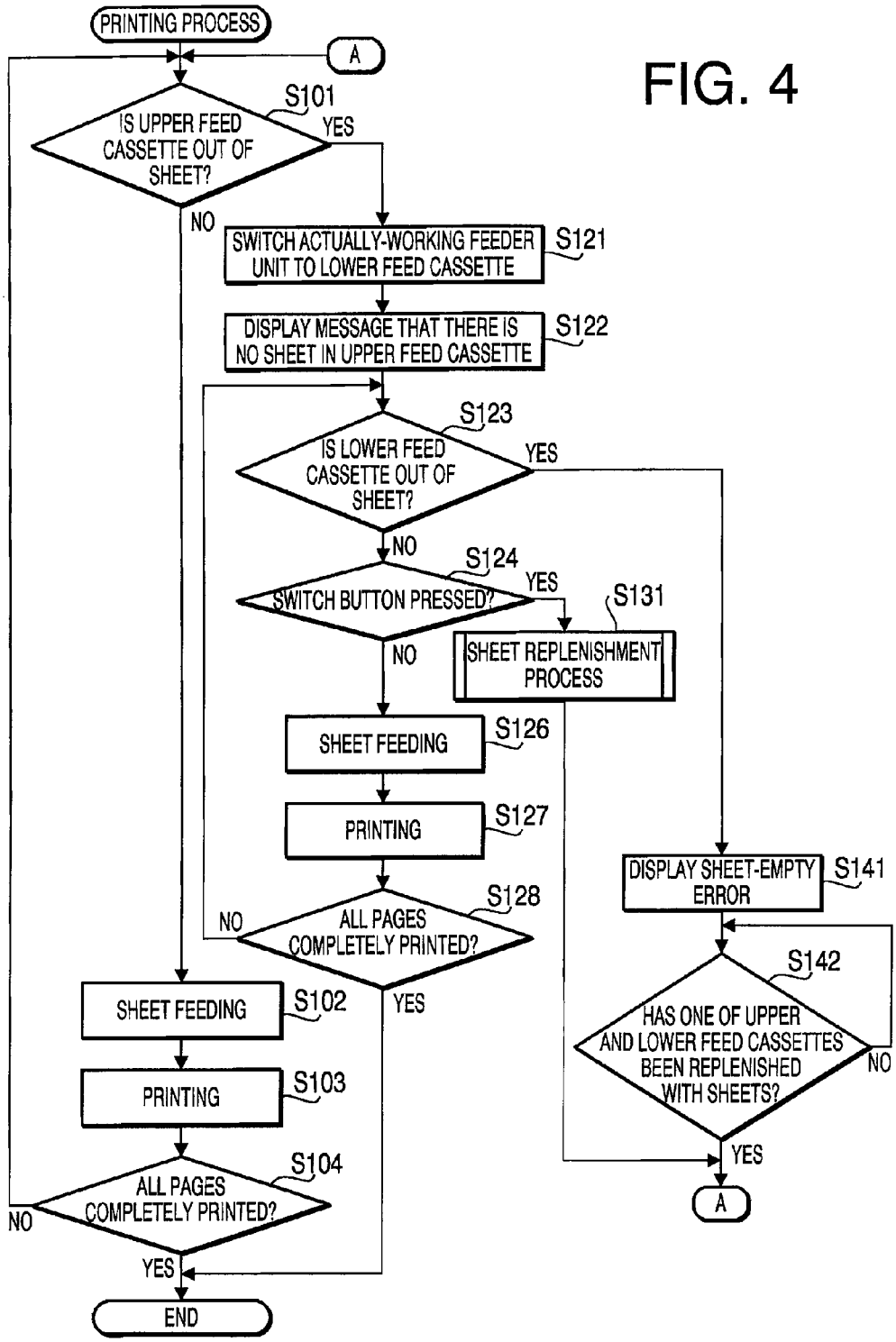
FIG. 4 is a flowchart showing a procedure of a printing process in the embodiment according to one or more aspects of the present invention.

Hereinafter, an explanation will be provided about a procedure of a printing process of the printer 100 for achieving the aforementioned printing operation, with reference to FIG. 4. The printing process is launched in response to receipt of print job data via the network interface 36. It is assumed that the printing process is initiated with the upper feed cassette 91 as an actually-working feeder unit.

First, the controller 30 determines whether the upper feed cassette 91 is in an out-of-sheet state (S101). The out-of-sheet state is recognized, for example, by detecting a change from the sheet-remaining state to the sheet-empty state based on output signals from the sheet sensor 61. When there is a sheet in the upper feed cassette 91 (S101: No), the controller 30 begins to feed a sheet from the upper feed cassette 91 (S102). After that, the controller 30 performs printing on the fed sheet (S103).

After execution of S103, the controller 30 determines whether printing has completely been performed for all pages (S104). When determining that printing has completely been performed for all pages (S104: Yes), the controller 30 terminates the printing process. When determining that an unprinted page still remains (S104: No), the controller 30 goes back to S101. In other words, the sheet feeding from the upper feed cassette 91 is repeatedly performed.

Meanwhile, when the upper feed cassette 91 is in the out-of-sheet state (S101: Yes), the controller 30 switches the actually-working feeder unit from the upper feed cassette 91 to the lower feed cassette 92 (S121). After that, the controller 30 displays, on the display unit 41 of the operation panel 40, a message that there is no sheet remaining in the upper feed cassette 91 (S122). At this time, the controller 30 concurrently displays one or more precautions or suggestions to notice in advance of replenishing the upper feed cassette 91 with sheets. For instance, the precautions or suggestions may include a message that sheet replenishment for the upper feed cassette 91 is made possible by pressing the switch button, as shown in FIG. 5.

Next, the controller 30 determines whether the lower feed cassette 92 is in an out-of-sheet state (S123). The out-of-sheet state is recognized, for example, by detecting a change from the sheet-remaining state to the sheet-empty state based on output signals from the sheet sensor 62. When determining that the lower feed cassette 92 is in an out-of-sheet state (S123: Yes), the controller 30 displays a sheet-empty error on the display unit 41 and interrupts the printing operation (S141). Then, the controller 30 determines whether one of the upper feed cassette 91 and the lower feed cassette 92 has been replenished with sheets (S142). When determining that any of the upper feed cassette 91 and the lower feed cassette 92 has not been replenished with sheets (S142: No), the controller 30 waits for one of the upper feed cassette 91 and the lower feed cassette 92 to be replenished with sheets.

Meanwhile, when determining that there is a sheet remaining in the lower feed cassette 92 (S123: No), the controller 30 determines whether the switch button of the operation panel 40 has been pressed (S124). When determining that the switch button of the operation panel 40 has not been pressed (S124: No), the controller 30 begins to feed a sheet from the lower feed cassette 92 (S126). Thereafter, the controller 30 performs printing on a sheet fed from the lower feed cassette 92 (S127).

After execution of S127, the controller 30 determines whether printing has completely been performed for all pages (S128). When determining that printing has completely been performed for all pages (S128: Yes), the controller 30 terminates the printing process. When determining that an unprinted page still remains (S128: No), the controller 30 goes back to S123, where the controller 30 performs printing for the unprinted page. In other words, the sheet feeding from the lower feed cassette 92 is repeatedly performed.

Meanwhile, when determining that the switch button of the operation panel 40 has been pressed (S124: Yes), the controller 30 carries out a sheet replenishment process to replenish the upper feed cassette 91 with sheets (S131). A detailed explanation will be provided below about the sheet replenishment process in S131 with reference to FIG. 6.

In the sheet replenishment process, the controller 30 first displays a guidance for sheet replenishment on the display unit 41 (S171). As an example of an initial display of the guidance, the controller 30 displays a message to prompt a user to set a sheet on the multipurpose tray 94 as shown in FIG. 7. At this time, since the sheet size of a sheet to be set, i.e., the sheet size conforming to the currently-executed printing operation is displayed, the user can know the sheet size of a sheet to be set on the multipurpose tray 94.

After execution of S171, the controller 30 determines whether a sheet has been set on the multipurpose tray 94 (S172). When determining that a sheet has not been set on the multipurpose tray 94 (S172: No), the controller 30 waits for a sheet to be set. The determination that a sheet has been set on the multipurpose tray 94 can be made by detecting the open state of the multipurpose tray 94 with the cover sensor 63 and detecting a change from the sheet-empty state to the sheet-remaining state based on the output signals from the sheet sensor 64.

After determining that a sheet has been set on the multipurpose tray 94 (S172: Yes), the controller 30 switches the actually-working feeder unit from the lower feed cassette 92 to the multipurpose tray 94 (S173). Then, the controller 30 begins to feed a sheet from the multipurpose tray 94 (S174). Thereby, the sheet fed from the multipurpose tray 94 is printed, and thus the continuous printing operation is maintained.

Thereafter, as illustrated in FIG. 8, the controller 30 displays on the display unit 41 a message that sheet replenishment for the upper feed cassette 91 has become possible (S175). At this time, since the sheet size conforming to the currently-executed printing operation is displayed, the user can know the sheet size of a sheet to be set on the upper feed cassette 91. The feeding path 14 from the multipurpose tray 94 does not pass through the upper feed cassette 91 or the lower feed cassette 92. Therefore, even though the upper feed cassette 91 is replenished with sheets, the feeding path 14 is not interrupted. Thus, it is possible to replenish the upper feed cassette 91 with sheets.

After that, the controller 30 determines whether sheet replenishment for the upper feed cassette 91 has completely been performed (S176). When determining that sheet replenishment for the upper feed cassette 91 has not completely been performed (S176: No), the controller 30 waits until sheet replenishment for the upper feed cassette 91 is completed. The determination that sheet replenishment for the upper feed cassette 91 has not completely been performed can be made, for example, by detecting a change from the sheet-empty state to the sheet-remaining state based on the output signals from the sheet sensor 61.

After completion of the sheet replenishment (S176: Yes), as shown in FIG. 9, the controller 30 displays on the display unit 41 a message that the completed sheet replenishment for the upper feed cassette 91 is confirmed and sheet feeding from the upper feed cassette 91 will be started after all sheets are fed out of the multipurpose tray 94 (S177). Following S177, the controller 30 determines whether there is no sheet left on the multipurpose tray 94 (S178). When determining that there is a sheet remaining on the multipurpose tray 94 (S178: No), the controller 30 waits until all sheets are fed out of the multipurpose tray 94.

After determining that there is no sheet left on the multipurpose tray 94 (S178: Yes), the controller 30 switches the actually-working feeder unit from the multipurpose tray 94 to the upper feed cassette 91 (S179). In other words, the actually-working feeder unit is restored to the original one. The upper feed cassette 91 has a larger capacity than that of the multipurpose tray 94. Thus, is order to avoid a trouble that might be caused in a subsequent job, it is desired to restore the actually-working feeder unit to the original one (i.e., the upper feed cassette 91).

Referring back to FIG. 4, after the upper feed cassette 91 (or the lower feed cassette 92) has been replenished with sheets, the controller 30 goes back to S101 to maintain the continuous printing operation.

As described above, the printer 100 of the embodiment includes the three feeder units (i.e., the upper feed cassette 91, the lower feed cassette 92, and the multipurpose tray 94), and the feeding paths 11, 12, and 14 that extend from the feeder units toward the registration rollers 75, respectively. Among the three feeder units, the multipurpose tray 94 is configured to feed a sheet even while the upper feed cassette 91 or the lower feed cassette 92 is being replenished with sheets. Further, the printer 100 is configured to switch the actually-working feeder unit to the multipurpose tray 94, from which sheet feeding is not influenced by sheet replenishment for the upper feed cassette 91, in a state where sheet replenishment for the upper feed cassette 91 is forbidden. Thereby, it is possible to replenish the upper feed cassette 91 with sheets, maintaining a continuous printing operation with the multipurpose tray 94 as the actually-working feeder unit.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

In the aforementioned embodiment, aspects of the present invention are applied to the printer 100. However, aspects of the present invention may be applied to devices having a printing function, such as a copy machine, a multi-function peripheral (MFP), and a facsimile machine. Further, the image forming method of the process portion 50 is not limited to the electrophotographic method, but may be an inkjet method.

In the aforementioned embodiment, in response to the switch button being pressed, it is permitted to switch the actually-working feeder unit to the multipurpose tray 94. However, the actually-working feeder unit may be switched to the multipurpose tray 94 in response to a sheet being set on the multipurpose tray 94, regardless of the switch button. It is noted that as exemplified in the aforementioned embodiment, when to switch the actually-working feeder unit to the multipurpose tray 94 is permitted in response to the switch button being pressed, it is possible to avoid undesired switching of the feeder unit even in a situation where a sheet is placed on the multipurpose tray 94 from the beginning.

In the aforementioned embodiment, in response to a sheet being set on the multipurpose tray 94 after the switch button is pressed, the actually-working feeder unit is automatically switched. However, for instance, a switch start button may be disposed on the operation panel 40. In this case, the actually-working feeder unit may be switched in response to the switch start button being pressed in a state where a sheet is set on the multipurpose tray 94.

In the aforementioned embodiment, when the actually-working feeder unit is restored to the original one in the sheet replenishment process, the controller 30 waits until all sheets are fed out of the multipurpose tray 94. However, the actually-working feeder unit may be restored to the original one in response to sheet replenishment for the upper feed cassette 91 being completed. In this case, the actually-working feeder unit may be restored to the original one (S179) after detection of a sheet replenished in S176, without executing S177 and S178. Thereby, it is possible to utilize the upper feed cassette 91 as the actually-working feeder unit earlier. On the other hand, as exemplified in the aforementioned embodiment, when the controller 30 waits until all sheets are fed out of the multipurpose tray 94 in the sheet replenishment process, it is possible to save troublesome operations such as cleaning up sheets remaining on the multipurpose tray 94.

In the aforementioned embodiment, in response to detection of the out-of-sheet state of the upper feed cassette 91, it is permitted to switch the actually-working feeder unit to the multipurpose tray 94, and thus it makes it possible to replenish the upper feed cassette 91 with sheets. However, the printer 100 may be configured to switch the actually-working feeder unit to the multipurpose tray 94 even during a continuous printing operation with the upper feed cassette 91 as the actually-working feeder unit. Thereby, the following effect can be provided. During the continuous printing operation with the upper feed cassette 91 as the actually-working feeder unit, the upper feed cassette 91 is forbidden to be replenished with sheets. However, according the above modification, by switching the actually-working feeder unit to the multipurpose tray 94 during the continuous printing operation, it is possible to replenish the upper feed cassette 91 with sheets, without interrupting the continuous printing operation.

Further, in the above modification, the feeder unit to be replenished during the continuous printing operation is the upper feed cassette 91, and the feeder unit temporarily used during the sheet replenishment is the multipurpose tray 94. However, for instance, the feeder unit to be replenished during the continuous printing operation may be the multipurpose tray 94, and the feeder unit temporarily used during the sheet replenishment may be the upper feed cassette 91. Further, the feeder unit to be replenished during the continuous printing operation may be the lower feed cassette 92, and the feeder unit temporarily used during the sheet replenishment may be the upper feed cassette 91.

What is claimed is:

1. A printer comprising:

a printing unit configured to print an image on a sheet;

a cassette configured to accommodate a sheet;

a first feeder configured to feed a sheet from the cassette to the printing unit;

a first sheet sensor configured to detect a sheet in the cassette;

a tray configured to accommodate a sheet;

a second feeder configured to feed a sheet from the tray to the printing unit;

a second sheet sensor configured to detect a sheet on the tray;

an input unit for receiving an instruction; and a controller configured to:

when determining with the first sheet sensor that there is a sheet in the cassette, control the first feeder to feed the sheet from the cassette to the printing unit and to control the printing unit to print an image on the sheet fed from the cassette;

when determining with the first sheet sensor that there is not a sheet in the cassette, in response to receipt of a predetermined instruction via the input unit, determine with the second sheet sensor whether there is a sheet on the tray; and in response to determining that there is a sheet in the tray, control the second feeder to feed the sheet from the tray to the printing unit and control the printing unit to print an image on the sheet fed from the tray.

2. The printer according to claim 1, wherein the controller is further configured to:

when controlling the second feeder to feed the sheet from the tray to the printing unit, determine with the first sheet sensor whether there is a sheet replenished in the cassette;

in response to determining that there is a sheet replenished in the cassette, determine with the second sheet sensor whether there is no sheet remaining on the tray; and in response to determining that there is no sheet remaining on the tray, control the first feeder to feed the replenished sheet from the cassette to the printing unit and control the printing unit to print an image on the replenished sheet fed from the cassette.

3. The printer according to claim 1, wherein a feeding path from the tray to the printing unit is formed to be continuous with a printing path on which a sheet is conveyed when the printing unit prints an image of the sheet, and wherein the feed path from the tray to the printing unit is formed independently from a feeding path from the cassette to the printing unit.

4. The printer according to claim 1, further comprising an informing unit configured to, when one or more sheets are placed on the second feeder, provide information that the first feeder is permitted to be replenished with sheets.

5. The printer according to claim 4, wherein the informing unit is further configured to inform of a size of a sheet settable on the first feeder during a continuous printing operation.

6. A printer comprising:

a printing unit configured to print an image on a sheet which is being conveyed on a printing path;

a first feeder unit configured such that a sheet placed thereon is fed to the printing path via a first feeding path;

a second feeder unit configured such that a sheet placed thereon is fed to the printing path via a second feeding path, wherein the second feeding path is forbidden to feed a sheet thereon while the first feeder unit is being replenished with sheets;

a third feeder unit configured such that a sheet placed thereon is fed to the printing path via a third feeding path, wherein the third feeding path is formed independently from the first and second feeding paths, so as to feed a sheet thereon even while the first feeder unit is being replenished with sheets; and a controller configured to:

in response to detecting a state where there is no sheet on the first feeder unit during sheet feeding from the first feeder unit, switch an actually-working feeder unit that works for actual sheet feeding, to the second feeder unit;

in response to a first requirement being satisfied during sheet feeding from the second feeder unit, switch the actually-working feeder unit to the third feeder unit, wherein the first requirement comprises a condition that one or more sheets are placed on the third feeder unit; and in response to a second requirement being satisfied during sheet feeding from the third feeder unit, restore the actually-working feeder unit to the first feeder unit, wherein the second requirement comprises a condition that an operation of replenishing the first feeder unit with sheets is completed.

7. A method, configured to be implemented on a processor, for controlling a printer that comprises:

a printing unit configured to print an image on a sheet which is being conveyed on a printing path;

a first feeder unit configured such that a sheet placed thereon is fed to the printing path via a first feeding path; and a second feeder unit configured such that a sheet placed thereon is fed to the printing path via a second feeding path even while the first feeder unit is being replenished with sheets, wherein the method comprises a step of, in response to a first requirement being satisfied while the first feeder unit is forbidden to be replenished with sheets during a continuous printing operation, switching an actually-working feeder unit that works for actual sheet feeding in the continuous printing operation, to the second feeder unit, and wherein the first requirement comprises a condition that one or more sheets are placed on the second feeder unit.

8. The method according to claim 7, further comprising a step of, in response to a second requirement being satisfied after switching the actually-working feeder unit to the second feeder unit, switching the actually-working feeder unit to the first feeder unit, wherein the second requirement comprises a condition that an operation of replenishing the first feeder unit with sheets is completed.

9. The method according to claim 8, wherein the second requirement comprises a condition that a state of the second feeder unit is changed from a state where there is a sheet thereon to a state where there is no sheet thereon.

10. The method according to claim 7, wherein the second feeding path is formed to extend to the printing path independently from the first feeding path without passing through the first feeding path.

11. The method according to claim 10, wherein the first requirement comprises a condition that a state of the second feeder unit is changed from a state where there is no sheet thereon to a state where there is a sheet thereon.

12. The method according to claim 11, wherein the first requirement comprises a condition that the processor accepts an instruction to switch the actually-working feeder unit.

13. The method according to claim 7, further comprising a step of, when one or more sheets are placed on the second feeder unit, providing information that the first feeder unit is permitted to be replenished with sheets.

14. The method according to claim 13, wherein the information contains information on a size of a sheet settable on the first feeder unit during the continuous printing operation.

* * * * *